US005250205A

United States Patent [19]

Akimoto et al.

[11] Patent Number: 5,250,205

[45] Date of Patent: Oct. 5, 1993

[54] LUBRICATING OIL

[75] Inventors: Shin-ichi Akimoto, Tokyo; Tohru Yasukohchi, Kanagawa; Kazuo Furuse, Kanagawa; Shinya Okumura, Kanagawa, all of Japan

[73] Assignee: Nippon Oil and Fats Co., Ltd., Tokyo, Japan

[21] Appl. No.: 801,633

[22] Filed: Dec. 4, 1991

Related U.S. Application Data

[63] Continuation of Ser. No. 514,901, Apr. 26, 1990, abandoned.

[30] Foreign Application Priority Data

Apr. 26, 1989 [JP] Japan ..... 1-104646
Feb. 28, 1990 [JP] Japan ..... 2-45702

[51] Int. Cl.[5] ..... C10M 129/16; C10M 145/04; C10M 145/24

[52] U.S. Cl. ..... 252/49.3; 252/49.5; 252/51.5 A; 252/56 R; 252/56 S; 252/56 D; 252/68

[58] Field of Search ..... 252/49.3, 49.5, 51.5 A, 252/56 R, 56 S, 56 D, 68

[56] References Cited

U.S. PATENT DOCUMENTS

| | | | |
|---|---|---|---|
| 4,332,689 | 6/1982 | Tanizaki et al. . | |
| 4,392,972 | 7/1983 | Mohr et al. | 252/68 |
| 4,404,114 | 9/1983 | Mohr et al. | 252/68 |
| 4,469,611 | 9/1984 | Snyder et al. . | |
| 4,689,166 | 8/1987 | Dohner | 252/56 D |
| 4,946,904 | 8/1990 | Akimoto et al. | 525/327.8 |
| 4,946,918 | 8/1990 | Akiyama et al. | 526/271 |
| 4,959,169 | 9/1990 | McGraw et al. | 252/68 |

FOREIGN PATENT DOCUMENTS

| | | |
|---|---|---|
| 0056627 | 7/1982 | European Pat. Off. . |
| 0282951 | 9/1988 | European Pat. Off. . |
| 0373621 | 6/1990 | European Pat. Off. . |
| 0379676 | 8/1990 | European Pat. Off. . |

OTHER PUBLICATIONS

Patent Abstracts of Japan, vol. 13, No. 427 (C-639) [3775], Sep. 22, 1989; & JP-A-1 163 297 (Nippon Oil & Fats Co., Ltd.) Jun. 27, 1989.

Patent Abstracts of Japan, vol. 6, No. 127 (C-113) [1005], Jul. 13, 1982; & JP-A-57 51 795 (Nippon Yushi K.K.); Mar. 26, 1982.

*Primary Examiner*—Jerry D. Johnson
*Attorney, Agent, or Firm*—Sughrue, Mion, Zinn, Macpeak & Seas

[57] ABSTRACT

A lubricating oil comprising a copolymer of monomers comprising as essential ingredients a compound represented by formula (1) and one of maleic anhydride, maleic acid, a salt of maleic acid, and an ester of maleic acid

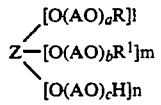

(1)

where Z represents a residue of a compound having from 2 to 8 hydroxyl groups; AO represents one or more kinds of oxyalkylene groups each having from 2 to 18 carbon atoms, provided that in the case of two or more kinds of oxyalkylene groups, the oxyalkylene groups are linked to one another in either a block or a random arrangement; R represents an alkenyl group having from 2 to 5 carbon atoms; $R^1$ represents a hydrocarbon or acyl group having from 1 to 24 carbon atoms; and $a \geqq 0$, $b \geqq 0$, $c \geqq 0$, l is a positive integer, and m and n independently are 0 or a positive integer, provided that $l+m+n=2$ to 8, $n/(l+m) \leqq \frac{1}{2}$, and $al+bm+cn=1$ to 1,000.

14 Claims, No Drawings

LUBRICATING OIL

This is a continuation of application Ser. No. 07/514,901 filed Apr. 26, 1990 now abandoned.

FIELD OF THE INVENTION

The present invention relates to a lubricating oil.

BACKGROUND OF THE INVENTION

Polyoxyalkylene glycol derivatives are used as lubricating oils in various applications. For example, water-soluble polyoxyalkylene glycol derivatives are used as hydraulic oils, cutting oil, grinding oil, gear oil, etc., polymers of polyoxyalkylene glycol (meth)acrylates are used as water-soluble lubricants (JP-A-56-47411), and compounds obtained by esterifying alkylene oxide adducts of castor oil are used as metal-working oils (JP-A-57-207699), while oil-soluble polyoxyalkylene glycol derivatives are used as viscosity index improvers for mineral oils (JP-B-53-44196), a refrigerating machine oil (JP-A-57-51795), etc. (The terms "JP-A" and "JP-B" as used herein mean an "unexamined published Japanese patent application" and an "examined Japanese patent publication", respectively.)

However, polymers of polyoxyalkylene glycol (meth)acrylates and derivatives of castor oil are defective in that their performances change if they are used in the form of an aqueous solution for a prolonged period of time, while oil-soluble polyoxyalkylene glycols also have the problem that their applications are limited since not only are they quite insoluble in water, although quite soluble in mineral oils, but it is impossible to emulsify mineral oils or the like in water.

SUMMARY OF THE INVENTION

It is, therefore, an object of the present invention to provide a lubricating oil which can be used in any of an aqueous solution, oily solution, and water-oil emulsion form.

The lubricating oil of the present invention comprises a copolymer of monomers comprising as essential ingredients a compound represented by formula (1) and one of maleic anhydride, maleic acid, a salt of maleic acid, and an ester of maleic acid

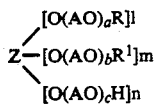

(1)

where Z represents a residue of a compound having from 2 to 8 hydroxyl groups; AO represents one or more kinds of oxyalkylene groups each having from 2 to 18 carbon atoms, provided that in the case of two or more kinds of oxyalkylene groups, the oxyalkylene groups are linked to one another in either a block or a random arrangement; R represents an alkenyl group having from 2 to 5 carbon atoms; $R^1$ represents a hydrocarbon or acyl group having from 1 to 24 carbon atoms; and $a \geqq 0$, $b \geqq 0$, $c \geqq 0$, l is a positive integer, and m and n independently are 0 or a positive integer, provided that $l+m+n=2$ to 8, $n/(l+m) \leqq \frac{1}{2}$, and $al+bm+cn=1$ to 1,000.

DETAILED DESCRIPTION OF THE INVENTION

Examples of the compound a residue of which is Z in formula (1) and which has from 2 to 8 hydroxyl groups include polyhydric phenols such as catechol, resorcin, hydroquinone, and phloroglucin; polyhydric alcohols such as ethylene glycol, propylene glycol, butylene glycol, dodecylene glycol, octadecylene glycol, neopentyl glycol, styrene glycol, glycerol, diglycerol, polyglycerol, trimethylolethane, trimethylolpropane, 1,3,5-pentanetriol, erythritol, pentaerythritol, dipentaerythritol, sorbitol, sorbitan, sorbide, a sorbitol-glycerol condensate, adonitol, arabitol, xylitol, and mannitol; saccharides such as xylose, arabinose, ribose, rhamnose, glucose, fructose, galactose, mannose, sorbose, cellobiose, maltose, isomaltose, trehalose, sucrose, raffinose, gentianose, and melezitose; and products of partial etherification or partial esterification of above compounds.

Examples of the oxyalkylene group having from 2 to 18 carbon atoms and represented by AO include an oxyethylene group, an oxypropylene group, an oxybutylene group, an oxytetramethylene group, an oxystyrene group, an oxydodecylene group, an oxytetradecylene group, an oxyhexadecylene group, and an oxyoctadecylene group. Of these, oxyalkylene groups having from 2 to 4 carbon atoms are particularly preferred.

Examples of the alkenyl group having from 2 to 5 carbon atoms and represented by R include a vinyl group, an allyl group, a methallyl group, a 3-butenyl group, a 4-pentenyl group, and a 3-methyl-3-butenyl group.

Examples of the hydrocarbon group having from 1 to 24 carbon atoms and represented by $R^1$ include a methyl group, an ethyl group, a propyl group, an isopropyl group, a butyl group, an isobutyl group, a tert-butyl group, a pentyl group, an isopentyl group, a hexyl group, a heptyl group, a decyl group, an undecyl group, a dodecyl group, an isotridecyl group, a tetradecyl group, a hexadecyl group, an isohexadecyl group, an octadecyl group, an isooctadecyl group, an oleyl group, an octyldodecyl group, a docosyl group, a decyltetradecyl group, a benzyl group, a cresyl group, a butylphenyl group, a dibutylphenyl group, an octylphenyl group, a nonylphenyl group, a dodecylphenyl group, a dioctylphenyl group, a dinonylphenyl group, a naphthyl group, and a styrenated phenyl group. Examples of the acyl group represented by $R^1$ include those derived from acetic acid, propionic acid, butyric acid, isobutyric acid, caprylic acid, pelargonic acid, 2-ethylhexanoic acid, capric acid, undecylenic acid, lauric acid, myristic acid, palmitic acid, margaric acid, stearic acid, arachic acid, behenic acid, palmitoleic acid, oleic acid, linoleic acid, linolenic acid, erucic acid, isopalmitic acid, isostearic acid, benzoic acid, hydroxybenzoic acid, cinnamic acid, and gallic acid.

Examples of the salt of maleic acid include alkali metal salts such as a lithium salt, a sodium salt, a potassium salt; alkaline earth metal salts such as a magnesium salt and calcium salt; an ammonium salt; and organic amine salts.

Examples of the organic amine salt include salts of aliphatic or aromatic monoamines such as a methylamine salt, an ethylamine salt, a propylamine salt, a butylamine salt, a pentylamine salt, a hexylamine salt, an octylamine salt, a 2-ethylhexylamine salt, a decylamine salt, a dodecylamine salt, an isotridecylamine salt, a tetradecylamine salt, a hexadecylamine salt, an isohexadecylamine salt, an octadecylamine salt, an isooctadecylamine salt, an octyldodecylamine salt, a docosylamine salt, a decyltetradecylamine salt, an oleylamine salt, a linolamine salt, a dimethylamine salt, a trimethylamine salt, and an aniline salt; polyamine salts such as an ethylenediamine salt, a tetramethylenediamine salt, a dodecylpropylenediamine salt, a tetradecylpropylenediamine salt, a hexadecylpropylenediamine salt, an octadecylpropylenediamine salt, an oleylpropylenediamine salt, a diethylenetriamine salt, a triethylenetetramine salt, a tetraethylenepentamine salt, and a pentaethylenehexamine salt; alkanolamine salts such as a monoethanolamine salt, a diethanolamine salt, a triethanolamine salt, a monoisopropanolamine salt, a diisopropanolamine salt, a triisopropanolamine salt, salts of alkylene oxide adducts of these amines, and salts of alkylene oxide adducts of mono- or diamines; and amino acid salts such as a lysine salt and an arginine salt. Particularly preferred of these are alkali metal salts, an ammonium salt, and alkanolamine salts.

Examples of the maleic acid ester include esters with alcohols such as methanol, ethanol, allyl alcohol, methallyl alcohol, propanol, isopropanol, butanol, isobutanol, tertbutanol, pentanol, isopentanol, hexanol, heptanol, 2-ethylhexanol, octanol, nonanol, decanol, undecanol, dodecanol, isotridecanol, tetradecanol, hexadecanol, isocetyl alcohol, octadecanol, isostearyl alcohol, oleyl alcohol, octyldodecanol, docosanol, and decyltetradecanol, and with alkylene oxide adducts of these alcohols; and maleic acid esters with alkylene oxide adducts of phenols such as phenol, cresol, butylphenol, octylphenol, nonylphenol, dodecylphenol, catechol, resorcinol, hydroquinone, and phloroglucinol. Examples of the maleic acid ester further include maleic acid esters with: polyhydric alcohols such as ethylene glycol, propylene glycol, butylene glycol, dodecylene glycol, octadecylene glycol, neopentyl glycol, styrene glycol, glycerol, diglycerol, polyglycerol, trimethylolethane, trimethylolpropoane, 1,3,5-pentanetriol, erythritol, pentaerythritol, dipentaerythritol, sorbitol, sorbitan, sorbide, a sorbitolglycerol condensate, adonitol, arabitol, xylitol, and mannitol; saccharides such as xylose, arabinose, ribose, rhamnose, glucose, fructose, galactose, mannose, sorbose, cellobiose, maltose, isomaltose, trehalose, sucrose, raffinoise, gentianose, and melezitose; products of partial etherification or partial esterification of the above polyhydric alcohols and saccharides, or alkylene oxide adducts of the above polyhydric alcohols and saccarides; alkylene oxide adducts of aliphatic or aromatic monoamines such as methylamine, ethylamine, propylamine, butylamine, amylamine, hexylamine, octylamine, 2-ethylhexylamine, decylamine, dodecylamine, isotridecylamine, tetradecylamine, hexadecylamine, isohexadecylamine, octadecylamine, isooctadecylamine, octyldodecylamine, docosylamine, decyltetradecylamine, oleylamine, linolamine, dimethylamine, trimethylamine, and aniline; alkylene oxide adducts of polyamines such as ethylenediamine, tetramethylenediamine, dodecylpropylenediamine, tetradecylpropylenediamine, hexadecylpropylenediamine, octadecylpropylenediamine, oleylpropylenediamine, diethylenetriamine, triethylenetetramine, tetraethylenepentamine, and pentaethylenehexamine; and alkanolamines such as monoethanolamine, diethanolamine, triethanolamine, monoisopropanolamine, diisopropanolamine, and triisopropanolamine, and alkylene oxide adducts of these alkanolamines.

The copolymer employed in the present invention can be obtained by copolymerizing the compound represented by formula (1) with maleic anhydride, maleic acid, a salt of maleic acid, or an ester of maleic acid by use of a radical catalyst. However, in the case of the copolymer with maleic acid or with a salt or an ester thereof, it is convenient to obtain the copolymer through the hydrolysis, the hydrolysis and subsequent neutralization or the esterification of a copolymer with maleic anhydride.

In the copolymerization of the compound represented by formula (1) with maleic anhydride, maleic acid, a maleic acid salt, or a maleic acid ester, the ratio of the compound of formula (1) to its comonomer is from 3:7 to 7:3 in terms of equivalent based on polymerizable double bond, with the particularly preferred ratio being about 1:1. In performing the copolymerization, other monomers may be added for copolymerization with the above monomers, but the amount of such other monomers used is not more than 30 mole % based on the total amount of all the monomers.

Examples of such other monomers include acrylic acid, methacrylic acid, itaconic acid, crotonic acid, salts of these acids with mono- or divalent metals, ammonium salts of the above acids, organic amine salts of the above acids, and esters of the above acids with alcohols having 1 to 24 carbon atoms, polyhydric alcohols, or with polyoxyalkylene glycols. Examples of other monomers further include aromatic vinyl compounds such as styrene and methylstyrene, halogenatd vinyl compounds such as vinyl chloride and vinylidene chloride, olefins such as isobutylene and diisobutylene, vinyl acetate, acrylonitrile, and acrylamide.

The weight-average molecular weight of the copolymer is generally from 1,000 to 2,000,000, preferably from 3,000 to 500,000.

The number of carbon atoms in R is from 2 to 5, which is the proper range since the carbon atom number affects the polymerizability of the compound of formula (1), with too long R resulting in poor polymerizability.

When the number of R, which is shown by l, is 1, a linear copolymer is formed, while if the number is 2 or larger, a crosslinked copolymer is formed.

Symbol n may be in the range of from 0 to 2. If n is too large, an ester with an acid is prone to be formed during the copolymerization reaction, so that the resulting copolymer has a high molecular weight to show too high a viscosity and to be less soluble in water and oils. For the above reason, n is preferably an integer that is not so large. Therefore, with regard to the relationship among l, m, and n, they should satisfy the equation $n/(l+m) \leqq \frac{1}{2}$.

Symbols a, b, and c are $a \geqq 0$, $b \geqq 0$, and $c \geqq 0$, and $(al+bm+cn)$ are from 1 to 1,000, preferably from 1 to 300, more preferably from 1 to 100.

The copolymer employed in this invention can be made either hydrophilic or lipophilic by varying the number of carbon atoms contained in AO in the compound of general formula (1), the molar amount of AO in the compound, combination of AO with $R^1$, and combination of the compound of formula (1) with maleic anhydride, maleic acid, a maleic acid salt, or a maleic acid ester.

The copolymer for use in the lubricating oil of this invention include those with various properties, such as a copolymer soluble in water but not in oils, a copolymer soluble in oils but insoluble in water, and a copolymer is soluble in both water and oils and emulsifying the both. Therefore, the lubricating oil of the present invention can be used in many applications.

Although the copolymer employed in this invention can be used alone as a lubricant, it may be used in combination with a mineral oil, an animal or vegetable fats and oils, a synthetic ester oil, a silicone oil, water, ethylene glycol, propylene glycol, glycerin, etc. In this case, the concentration of the copolymer is from 0.01 to 80%, preferably from 0.1 to 50%, by weight. In the case where the copolymer is for use in a refrigerating machine oil, the oil is required to be soluble in refrigerants such as Freon R-11 (trichloromonofluoromethane), Freon R-12 (dichlorodifluoromethane), Freon R-22 (monochlorodifluoromethane), Freon R-134a (1,1,1,2-tetrafluoroethane), and Freon R-152a (1,1-difluoroethane). Hence, it is preferred to use the copolymer in combination with a polyoxyalkylene glycol derivative having an average molecular weight of 1,000 or less so as to be soluble in refrigerants. Examples of such polyoxyalkylene glycol derivative include polypropylene glycol, mono- or dialkyl ethers thereof, polyoxypropylene glycerol ether, a polyoxyethylenepolyoxypropylene glycol (having an oxyethylene group content of 50 mole % or less), mono- or dialkyl ethers thereof, and a polyoxyethylenepolyoxypropylene glycerol ether. If the polyoxyalkylene glycol derivative is an adduct of two or more kinds of alkylene oxides, it may be either a block adduct or a random adduct.

The lubricating oil of this invention, which comprises a copolymer of monomers comprising as essential ingredients the compound of formula (1) and one of maleic anhydride, maleic acid, a maleic acid salt, and a maleic acid ester, shows an excellent lubricating effect in any of an aqueous solution, emulsion, and oily solution form.

Therefore, the lubricating oil of this invention can be used in various lubricating applications as a hydraulic fluid, gear oil, cutting oil, grinding oil, pressing oil, rolling oil, drawing oil, sliding oil, etc.

The present invention is described below in further detail by way of Examples.

The following Table 1 shows the compositions (monomer proportions) and weight-average molecular weights of the copolymers used in Examples 1 to 4 below.

TABLE 1

| No. | Compound of formula (1) | (mole) | Maleic anhydride (mole) | Other monomer (mole) | Base (mole) | Weight-average molecular weight |
|---|---|---|---|---|---|---|
| 1 | $CH_2{=}C(CH_3){-}CH_2O(C_2H_4O)_{40}CH_3$ | 1.0 | 1.0 | — | triethylamine 1.0 | 100,000 |
| 2 | $CH_2{=}CHCH_2O(C_3H_6O)_{12}C_4H_9$ | 0.95 | 1.0 | styrene 0.05 | triethanolamine 1.0 | 30,000 |
| 3 | $CH_2{=}CHCH_2O\{(C_3H_6O)_5(C_2H_4O)_5\}C_2H_5$ | 1.0[1)] | 1.0 | — | triisopropanolamine 1.1 | 40,000 |
| 4 | $CH_2{=}CHCH_2O(C_2H_4O)_{16}(C_3H_6O)_{20}CH_3$ | 1.0 | 1.0 | — | diethanolamine 1.0 | 50,000 |
| 5 | $CH_2OCH_2CH{=}CH_2$<br>\|<br>$CHO(C_2H_4O)_{50}H$<br>\|<br>$CH_2OCH_3$ | 1.0 | 1.0 | — | ethylenediamine 0.6 | 45,000 |
| 6 | $CH_2{=}CHCH_2O(C_2H_4O)_{20}{-}C_6H_4{-}C_9H_{19}$ | 0.95 | 1.0 | styrene 0.05 | treithanolamine 1.0 | 15,000 |
| 7 | $CH_2{=}C(CH_3){-}CH_2O\{(C_4H_8O)_2(C_2H_4O)_8\}C_{12}H_{25}$ | 1.0[1)] | 1.0 | — | triethylamine 1.1 | 20,000 |
| 8 | $CH_2{=}CHCH_2O(C_2H_4O)_{30}C_{18}H_{37}$ | 1.0 | 1.0 | — | potassium hydroxide 1.0 | 15,000 |
| 9 | $CH_2OCH_2CH{=}CH_2$<br>\|<br>$CHO(C_3H_6O)_5(C_2H_4O)_{20}CH_2C_6H_5$<br>\|<br>$CH_2O(C_3H_6O)_5(C_2H_4O)_{20}CH_2C_6H_5$ | 1.0 | 1.0 | — | triisopropanolamine 0.9 | 20,000 |

Note:
[1)]The unit in { } is a random adduct.

EXAMPLE 1

Copolymers Nos. 1 to 5 shown in Table 1 were used as a base oil to prepare water-based lubricants according to the following formulation. The thus-obtained lubricants were evaluated for properties. For the purpose of comparison, lubricants prepared using conventional polyoxyalkylene glycols as a base oil in place of the copolymers were likewise subjected to a performance test.

| Formulation | |
|---|---|
| Base oil | 18.00 wt % |
| Propylene glycol | 37.00 wt % |
| Ion-exchanged water | 40.00 wt % |
| Oleic acid | 3.45 wt % |
| Morpholine | 0.60 wt % |
| Benzotriazole | 0.10 wt % |
| Potassium hydroxide | 0.85 wt % |
| Dimethylpolysiloxane | 100 ppm based on the |

-continued

| Formulation | |
|---|---|
| (viscosity 350 cSt) | sum of the above. |

The results of the performance test are shown in Table 2. Table 2 shows that the lubricating oils of this invention employing the specific copolymers as base oils have excellent performances.

TABLE 2

| | Copolymer | Kinematic viscosity 40° C. (cSt) | Viscosity index VIE | Pour point (°C.) | Foaming test JIS K-2518 24° C. (mm) 0 min. | After 10 min. | Soda 4-ball test JIS K-2519 220 rpm (kg/cm²) | Timken wear test JIS K-2519 Maximum load (lbs) | Film strength (psi) |
|---|---|---|---|---|---|---|---|---|---|
| Present Invention | No. 1 | 47.2 | 189 | −50.0 | 35 | 0 | 9.5 | 42 | 32,000 |
| Present Invention | No. 2 | 46.5 | 193 | −50.0 | 25 | 0 | 10.5 | 47 | 33,000 |
| Present Invention | No. 3 | 46.3 | 192 | −50.0 | 35 | 0 | 10.0 | 45 | 31,500 |
| Present Invention | No. 4 | 46.8 | 190 | −50.0 | 30 | 0 | 10.0 | 45 | 30,000 |
| Present Invention | No. 5 | 45.9 | 188 | −45.0 | 50 | 0 | 9.0 | 40 | 26,000 |
| Comparative Example | Polyoxy-ethylene-propylene glycol[1)] | 46.3 | 185 | −45.0 | 80 | 0 | 8.5 | 36 | 18,400 |
| Comparative Example | Polyethylene glycol[2)] | 44.8 | 187 | −37.5 | 165 | 10 | 7.5 | 34 | 15,100 |

[1)]Weight-average molecular weight 11,000; a random adduct in which oxyethylene group: oxypropylene group = 75:25 (by weight).
[2)]Weight-average molecular weight 20,000.

EXAMPLE 2

Copolymers Nos. 3, 4, 6, 7, 8, and 9 shown in Table 1 were used to prepare cutting oils according to the following formulation. The cutting oils thus obtained were subjected to a cutting and working test (JIS B-4012) under the following conditions. The results obtained are shown in Table 3.

| Formulation | |
|---|---|
| Machine oil | 80.0 wt % |
| Copolymer | 20.0 wt % |
| Conditions for Cutting and Working Test | |
| Test specimen | Free-machining stainless steel (SAE 51-416F) 40 ϕ × 300 (mm) |
| Cutting tool | SKH-4B (JIS G-4403) |
| Cutting speed | 70 m/min. |
| Working speed | 8 μ/min. |
| Flow of cutting oil | 1 l/min. |

For the purpose of comparison, polyoxyethylene (7 mole) monooleate was used in place of the copolymers to perform the same test. The results obtained are shown in Table 3, in which the performance of each cutting oil is expressed in terms of the number of test specimens that were able to be cut with one cutting tool. Table 3 shows that the cutting oils of this invention employing the specific copolymers are highly effective.

TABLE 3

| | Copolymer | Number of specimens cut: Cutting tool 1 | Cutting tool 2 | Cutting tool 3 |
|---|---|---|---|---|
| Present Invention | No. 3 | 1385 | 1402 | 1377 |

TABLE 3-continued

| | Copolymer | Number of specimens cut: Cutting tool 1 | Cutting tool 2 | Cutting tool 3 |
|---|---|---|---|---|
| Present Invention | No. 4 | 1364 | 1388 | 1395 |
| Present Invention | No. 6 | 1433 | 1405 | 1414 |
| Present Invention | No. 7 | 1424 | 1413 | 1409 |
| Present Invention | No. 8 | 1410 | 1412 | 1396 |
| Present Invention | No. 9 | 1407 | 1400 | 1388 |
| Comparative | Polyoxyethylene (7 mole) monooleate | 820 | 831 | 819 |

EXAMPLE 3

Each of the cutting oils formulated in Example 2 was used to prepare an emulsion consisting of 2% by weight of the cutting oil and 98% by weight of ion-exchanged water. The emulsions thus obtained were subjected to a cutting test under the same conditions as in Example 2. The results obtained are shown in Table 4. Table 4 shows that the lubricants of this invention are excellent even in the form of a cutting oil of the emulsion type.

TABLE 4

| | Copolymer | Number of specimens cut: Cutting tool 1 | Cutting tool 2 | Cutting tool 3 |
|---|---|---|---|---|
| Present Invention | No. 3 | 1291 | 1300 | 1284 |
| Present Invention | No. 4 | 1195 | 1253 | 1203 |
| Present Invention | No. 6 | 1312 | 1314 | 1336 |
| Present Invention | No. 7 | 1325 | 1306 | 1341 |
| Present Invention | No. 8 | 1342 | 1322 | 1318 |
| Present Invention | No. 9 | 1224 | 1275 | 1236 |
| Comparative | Polyoxyethylene (7 mole) monooleate | 706 | 698 | 721 |

EXAMPLE 4

With respect to the compositions shown in Table 5, a test for evaluating solubility in Freon R-12 and Freon R-134a and a Timken wear test were conducted. The results are shown in Table 6. In the solubility test, a composition shown in Table 5 and a Freon were placed in a pressure vessel made of glass and visually examined as to whether the mixture in the vessel became whitely turbid or not over a temperature range of from −5° to 60° C. Compositions that resulted in white turbidity were judged to be insoluble.

Table 6 shows that the lubricating oils of this invention are excellent not only in the solubility in refrigerants, Freons, but also in lubricating performance.

TABLE 6

| | | Solubility test | | Timken wear test | |
|---|---|---|---|---|---|
| | No. | Freon R-12 | Freon R-134a | Maximum load (lbs) | Film strength (psi) |
| Present Invention | 10 | soluble | soluble | 56 | 36,000 |
| Present Invention | 11 | " | " | 52 | 32,000 |
| Present Invention | 12 | " | " | 50 | 30,000 |
| Present Invention | 13 | " | " | 51 | 31,000 |
| Present Invention | 14 | " | " | 52 | 32,000 |
| Present Invention | 15 | " | " | 56 | 35,000 |
| Present Invention | 16 | " | " | 53 | 32,000 |
| Present Invention | 17 | " | " | 57 | 36,000 |

TABLE 5

| | Copolymer | | | | | |
|---|---|---|---|---|---|---|
| No. | Compound of formula (1) or other monomer | (mole) | Maleic anhydride (%) | Alcohol | (mole) | Weight-average molecular weight |
| 10* | $CH_2{=}CHCH_2O(C_3H_6O)_{12}CH_3$ | 1.0 | 1.0 | — | | 18,000 |
| 11* | $CH_2CHCH_2O(C_2H_4O)_2(C_3H_6O)_7C_4H_9$ | 1.0 | 1.0 | — | | 13,500 |
| 12* | $CH_2{=}CHCH_2O(C_3H_6O)_5C_9H_{19}$ | 1.0 | 1.0 | — | | 9,000 |
| 13* | $CH_2{=}CHCH_2O(C_3H_6O)_9COCH_3$ | 1.0 | 1.0 | — | | 12,000 |
| 14* | $CH_2{=}C(CH_3)CH_2O(C_3H_6O)_5CH_3$ | 1.0 | 1.0 | — | | 40,000 |
| 15* | $CH_2{=}CHCH_2O(C_3H_6O)_{12}CH_3$ | 1.0 | 1.0 | $CH_3O(C_3H_6O)_3H$ | 1.0 | 23,000 |
| 16* | $CH_2{=}CHCH_2O(C_2H_4O)_2(C_3H_6O)_7C_4H_9$ | 1.0 | 1.0 | $C_4H_9OH$ | 0.2 | 14,000 |
| 17* | $CH_2{=}C(CH_3)CH_2O(C_3H_6O)_5CH_3$ | 1.0 | 1.0 | $C_4H_9O(C_2H_4O)_2(C_3H_6O)_7H$ | 1.0 | 50,000 |
| 18** | — | — | — | — | | — |
| 19** | — | — | — | — | | — |
| 20** | isobutylene | 1.0 | 1.0 | — | | 8,000 |
| 21** | methyl vinyl ether | 1.0 | 1.0 | $C_4H_9OH$ | 1.0 | 12,000 |

| | Polyoxyalkylene glycol derivative | | |
|---|---|---|---|
| No. | Amount (%) | Structural formula[1)] | Amount (%) |
| 10* | 5.0 | $CH_3O(C_3H_6O)_{12}H$ | 95.0 |
| 11* | 2.0 | $C_4H_9O(C_3H_6O)_9H$ | 98.0 |
| 12* | 3.0 | $C_9H_{19}O(C_3H_6O)_5H$ | 97.0 |
| 13* | 2.0 | $HO(C_3H_6O)_{15}H$ | 98.0 |
| 14* | 2.0 | $CH_2O(C_3H_6O)_4H$<br>\|<br>$CHO(C_3H_6O)_4H$<br>\|<br>$CH_2O(C_3H_6O)_4H$ | 98.0 |
| 15* | 7.0 | $CH_3O(C_3H_6O)_{12}CH_3$ | 93.0 |
| 16* | 5.0 | $CH_3\{(C_3H_6O)_9(C_2H_4O)_3\}H$ | 95.0 |
| 17* | 3.0 | $C_9H_{19}O(C_3H_6O)_5H$ | 97.0 |
| 18** | — | $HO(C_3H_6O)_{15}H$ | 100.0 |
| 19** | — | $CH_2O(C_3H_6O)_4H$<br>\|<br>$CHO(C_3H_6O)_4H$<br>\|<br>$CH_2O(C_3H_6O)_4H$ | 100.0 |
| 20** | 3.0 | $CH_3O(C_3H_6O)_{12}H$ | 97.0 |
| 21** | 3.0 | $HO(C_3H_6O)_{15}H$ | 97.0 |

Note:
[1)]The unite in { } is a random adduct.
*Present invention
**Comparative

TABLE 6-continued

| | No. | Solubility test Freon R-12 | Solubility test Freon R-134a | Timken wear test Maximum load (lbs) | Timken wear test Film strength (psi) |
|---|---|---|---|---|---|
| Comparative | 18 | " | " | 35 | 17,000 |
| " | 19 | " | " | 35 | 17,000 |
| " | 20 | insoluble | insoluble | 36 | 18,000 |
| " | 21 | " | " | 37 | 19,000 |

While the invention has been described in detail and with reference to specific embodiments thereof, it will be apparent to one skilled in the art that various changes and modifications can be made therein without departing from the spirit and scope thereof.

What is claimed is:

1. In a method of lubricating a substance wherein the improvement comprises lubricating said substance with a copolymer of monomers comprising as essential ingredients a compound represented by formula (1) and one of maleic anhydride, maleic acid, a salt of maleic acid, and an ester of maleic acid $$Z\begin{cases}[O(AO)_aR]l \\ [O(AO)_bR^1]m \\ [O(AO)_cH]n\end{cases} \quad (1)$$

where Z represents a residue of a compound having from 2 to 8 hydroxyl groups; AO represents one or more kinds of oxyalkylene groups each having from 2 to 18 carbon atoms, provided that in the case of two or more kinds of oxyalkylene groups, the oxyalkylene groups are linked to one another in either a block or a random arrangement; R represents an alkenyl group having from 2 to 5 carbon atoms; $R^1$ represents a hydrocarbon or acyl group having from 1 to 24 carbon atoms; and $a \geqq 0$, $b \geqq 0$, $c \geqq 0$, 1 is a positive integer, and m and n independently are 0 or a positive integer, provided that $l+m+n=2$ to 8, $n/(l+m) \leqq \frac{1}{2}$, and $al+bm+cn=1$ to 1,000.

2. In a method of lubricating a substance wherein the improvement comprises lubricating said substance with (a) a copolymer of monomers comprising as essential ingredients a compound represented by formula (1) and one of maleic anhydride, maleic acid, a salt of maleic acid, and an ester of maleic acid $$Z\begin{cases}[O(AO)_aR]l \\ [O(AO)_bR^1]m \\ [O(AO)_cH]n\end{cases} \quad (1)$$

where Z represents a residue of a compound having from 2 to 8 hydroxyl groups; AO represents one or more kinds of oxyalkylene groups each having from 2 to 18 carbon atoms, provided that in the case of two or more kinds of oxyalkylene groups, the oxyalkylene groups are linked to one another in either a block or a random arrangement; R represents an alkenyl group having from 2 to 5 carbon atoms; $R^1$ represents a hydrocarbon or acyl group having from 1 to 24 carbon atoms; and $a \geqq 0$, $b \geqq 0$, $c \geqq 0$, 1 is a positive integer, and m and n independently are 0 or a positive integer, provided that $l+m+n=2$ to 8, $n/(l+m) \leqq \frac{1}{2}$, and $al+bm+cn=1$ to 1,000, and (b) a liquid medium.

3. The method as claimed in claim 2, wherein said liquid medium is selected from the group consisting of a mineral oil, an animal or vegetable fat or oil, a synthetic ester oil, a silicone oil, water, ethylene glycol, propylene glycol, glycerin, polypropylene glycol, mono- or dialkyl ethers thereof, polyoxypropylene glycerol ether, a polyoxyethylenepolyoxypropylene glycol having an oxyethylene group content of 50 mole % or less, mono- or dialkyl ethers thereof, and a polyoxyethylenepolyoxypropylene glycerol ether.

4. The method as claimed in claim 2, wherein said liquid medium is an aqueous medium, an oily medium, or an emulsion consisting of an aqueous medium and an oily medium.

5. The method as claimed in claim 2, wherein the content of said copolymer in the composition is from 0.01 to 80% by weight.

6. The method as claimed in claim 2, wherein the (a) copolymer of a compound represented by formula (1) and the (b) liquid medium is used as a hydraulic fluid.

7. The method as claimed in claim 2, wherein the (a) copolymer of a compound represented by formula (1) and the (b) liquid medium is used as a gear oil.

8. The method as claimed in claim 2, wherein the (a) copolymer of a compound represented by formula (1) and the (b) liquid medium is used as a cutting oil.

9. The method as claimed in claim 2, wherein the (a) copolymer of a compound represented by formula (1) and the (b) liquid medium is used as a grinding oil.

10. The method as claimed in claim 2, wherein the (a) copolymer of a compound represented by formula (1) and the (b) liquid medium is used as a pressing oil.

11. The method as claimed in claim 2, wherein the (a) copolymer of a compound represented by formula (1) and the (b) liquid medium is used as a rolling oil.

12. The method as claimed in claim 2, wherein the (a) copolymer of a compound represented by formula (1) and the (b) liquid medium is used as a drawing oil.

13. The method as claimed in claim 2, wherein the (a) copolymer of a compound represented by formula (1) and the (b) liquid medium is used as a sliding oil.

14. The method as claimed in claim 2, wherein the (a) copolymer of a compound represented by formula (1) and the (b) liquid medium is used as a refrigerating machine oil.

* * * * *